US006738446B2

(12) United States Patent
Venneri et al.

(10) Patent No.: US 6,738,446 B2
(45) Date of Patent: May 18, 2004

(54) SYSTEM AND METHOD FOR RADIOACTIVE WASTE DESTRUCTION

(75) Inventors: Francesco Venneri, Los Alamos, NM (US); Alan M. Baxter, Los Alamos, NM (US); Carmelo Rodriguez, Cardiff, CA (US); Donald McEachern, Poway, CA (US); Mike Fikani, Albuquerque, NM (US)

(73) Assignee: General Atomics, San Diego, CA (US)

( * ) Notice: Subject to any disclaimer, the term of this patent is extended or adjusted under 35 U.S.C. 154(b) by 0 days.

(21) Appl. No.: 10/281,380

(22) Filed: Oct. 25, 2002

(65) Prior Publication Data

US 2003/0156675 A1 Aug. 21, 2003

Related U.S. Application Data

(63) Continuation-in-part of application No. 09/511,749, filed on Feb. 24, 2000, now Pat. No. 6,472,677.

(51) Int. Cl.[7] ..... G21G 1/08; G21C 1/12; G21C 1/30

(52) U.S. Cl. ..... 376/189; 376/170; 376/192; 376/194; 376/351; 376/395; 376/901; 376/904

(58) Field of Search ..... 376/343, 357, 376/395, 427, 901, 904, 170–173, 189, 192–195

(56) References Cited

U.S. PATENT DOCUMENTS

| | | | | |
|---|---|---|---|---|
| 3,649,452 A | * | 3/1972 | Chin et al. | 376/904 |
| 4,780,682 A | | 10/1988 | Politzer | 328/233 |
| 4,987,007 A | | 1/1991 | Wagal | 427/53.1 |
| 5,160,696 A | | 11/1992 | Bowman | 376/189 |
| 5,513,226 A | * | 4/1996 | Baxter et al. | 376/170 |
| 6,233,298 B1 | | 5/2001 | Bowman | 376/171 |
| 6,472,677 B1 | * | 10/2002 | Rodriguez et al. | 250/573 |

* cited by examiner

*Primary Examiner*—Jack Keith
(74) *Attorney, Agent, or Firm*—Nydegger & Associates

(57) ABSTRACT

A method for transmuting spent fuel from a nuclear reactor includes the step of separating the waste into components including a driver fuel component and a transmutation fuel component. The driver fuel, which includes fissile materials such as Plutonium$^{239}$, is used to initiate a critical, fission reaction in a reactor. The transmutation fuel, which includes non-fissile transuranic isotopes, is transmuted by thermal neutrons generated during fission of the driver fuel. The system is designed to promote fission of the driver fuel and reduce neutron capture by the driver fuel. Reacted driver fuel is separated into transuranics and fission products using a dry cleanup process and the resulting transuranics are mixed with transmutation fuel and re-introduced into the reactor. Transmutation fuel from the reactor is introduced into a second reactor for further transmutation by neutrons generated using a proton beam and spallation target.

10 Claims, 7 Drawing Sheets

SYSTEM AND METHOD FOR RADIOACTIVE WASTE DESTRUCTION

The present application is a continuation-in-part of U.S. patent application Ser. No. 09/511,749 filed Feb. 24, 2000 now U.S. Pat. No. 6,472,677, the contents of which are hereby incorporated by reference herein.

FIELD OF THE INVENTION

The present invention pertains generally to systems and methods for the destruction of high-level radioactive waste. More particularly, the present invention pertains to methods for converting the spent fuel from a nuclear reactor into a form which is suitable for long term storage at a repository. The present invention is particularly, but not exclusively, useful for transmuting Plutonium$^{239}$ and other transuranics found in spent nuclear fuel into more stable, less radiotoxic materials.

BACKGROUND OF THE INVENTION

It is well known that spent nuclear fuel is highly radiotoxic and poses several challenging threats to mankind, including nuclear proliferation, radiation exposure and environmental contamination. To date, approximately 90,000 spent fuel assemblies containing about 25,000 tons of spent radioactive fuel are stored in the United States. Furthermore, with additional spent fuel assemblies being generated each year, it is estimated there will be about 70,000 tons of spent fuel waste by the year 2015. At the rate waste is produced by the existing nuclear reactors in the United States, new repository capacity would be needed every 20–30 years equal to the statutory capacity of the yet-to-open Geological Repository at Yucca Mountain. Currently, about 95% of this radiotoxic material is temporarily stored at the point of generation (i.e. at the power plant) in water pools, with a small amount being stored in dry storage (casks).

A typical spent fuel assembly removed from a commercial nuclear power plant, such as a Light Water Reactor, contains four major constituents: Uranium (about 95%), fissile transuranics including Plutonium$^{239}$ (0.9%), non-fissile transuranics including certain isotopes of Americium, Plutonium, Curium and Neptunium (0.1%), and fission products (balance). After a relatively short time, the Uranium and a portion of the fission products are generally no more radiotoxic than natural Uranium ore. Consequently, these components of the spent fuel do not require transmutation or special disposal. The remaining fission products can be used as a burnable poison in a commercial reactor followed by disposal at a repository.

The fissile and non-fissile transuranics, however, require special isolation from the environment or transmutation to non-fissile, shorter lived forms. Destroying at least 95% of these transuranics followed by disposal in advanced containers (i.e. containers better than simple steel containers) represents a much better solution than merely stockpiling the waste in the form of fuel rods. In one transmutation scheme, the transuranics are transmuted in a reactor, followed by a separation step to concentrate the remaining transuranics, followed by further transmutation. Unfortunately, this cycle must be repeated 10–20 times to achieve a desirable destruction level of 95%, and consequently, is very time consuming and expensive.

In another transmutation scheme, fast neutrons are used to transmute the non-fissile transuranics. For example, fast neutrons generated by bombarding a spallation target with protons are used. Although these fast spectrum systems generate a large number of neutrons, many of the neutrons are wasted, especially in subcritical systems. Further, these fast neutrons can cause serious damage to fuel and structures, limiting the useful life of the transmutation devices.

In light of the above, it is an object of the present invention to provide devices suitable for transmuting fissile and non-fissile transuranics to achieve relatively high destruction levels without requiring multiple reprocessing steps. It is another object of the present invention to provide systems and methods for efficiently transmuting fissile and non-fissile transuranics with thermal neutrons. It is yet another object of the present invention to provide systems and methods for efficiently transmuting fissile and non-fissile transuranics which use neutrons released during the fission of fissile transuranics to transmute the non-fissile transuranics.

SUMMARY OF THE INVENTION

In accordance with the present invention, a system and method for transmuting spent fuel (i.e. radioactive waste) from a nuclear reactor, such as a Light Water Reactor, includes the step of separating the waste into components. For the present invention, a conventional UREX process can be used to separate the spent fuel into components that include a Uranium component, a fission products component, a driver fuel component and a transmutation fuel component. After the separation, the driver fuel and transmutation fuel components are placed in a reactor with a thermal neutron spectrum for transmutation into less hazardous materials. On the other hand, the Uranium component is relatively non-radioactive and can be disposed of without transmutation. Also, the fission products may be transmuted into short-lived, non-toxic forms in commercial thermal reactors.

The driver fuel, which includes fissile materials such as Plutonium$^{239}$, is used to initiate a critical, self-sustaining, thermal-neutron fission reaction in the first reactor. The transmutation fuel, which includes non-fissile materials, such as certain isotopes of Americium, Plutonium, Neptunium and Curium, is transmuted by the neutrons released during fission of the driver fuel. The transmutation fuel also provides stable reactivity feedback and makes an important contribution to ensure that the reactor is passively safe. The system is designed to promote fission of the driver fuel and reduce excessive neutron capture by the driver fuel. More specifically, the system is designed to minimize exposure of the driver fuel to thermal neutrons within an energy band wherein the driver fuel has a relatively high neutron capture cross-section and a relatively low fission cross-section. In one implementation, the driver fuel is formed into spherical particles having a relatively large diameter (e.g. approximately 300 $\mu$m) to minimize neutron capture by the so called self-shielding effect.

The transmutation fuel is formed into relatively small, substantially spherical particles having a diameter of approximately 150 $\mu$m in diameter (or diluted 250 $\mu$m particles) to maximize exposure of the small amount of the transmutation fuel to epithermal neutrons (i.e. thermal neutrons at the high energy end of the thermal neutron energy spectrum). These neutrons interact with the transmutation fuel atoms in the so-called resonance epithermal region and destroy them in a capture-followed-by-fission sequence. Additionally, the particles are placed in graphite blocks which moderate neutrons from the fission reaction. A relatively high ratio of graphite mass to driver fuel mass is used in the first reactor to slow down neutrons to the desired energy levels that promote fission over capture in the driver fuel.

The driver fuel and transmutation fuel remain in the first reactor for approximately three years, with one third of the reacted driver fuel and transmutation fuel removed each year and replaced with fresh fuel. Upon removal from the first reactor, the reacted driver fuel consists of approximately one-third transuranics and two-thirds fission products. The transuranics in the reacted driver fuel are then separated from the fission products using a baking process to heat up and evaporate volatile elements. The resulting fission products can be sent to a repository and the transuranics left over can be mixed with transmutation fuel from the UREX separation and re-introduced into the first reactor for further transmutation.

Transmutation fuel that has been removed from the first reactor after a three year residence time is then introduced into a second reactor for further transmutation. The second reactor includes a sealable, cylindrical housing having a window to allow a beam of protons to pass through the window and into the housing. A spallation target is positioned inside the housing and along the proton beam path. Fast neutrons are thereby released when the beam of protons enters the housing and strikes the spallation target.

Graphite blocks containing the transmutation fuel are positioned inside the housing at a distance from the spallation target. A relatively low ratio of graphite mass to transmutation fuel mass is used in the second reactor to allow epithermal neutrons to reach the transmutation fuel. However, enough graphite is used to achieve the desired moderation for transmutation, with the attendant effect that fast neutron damage to reactor structures and equipment is limited. After a residence time in the second reactor of approximately four years, the reacted transmutation fuel is removed from the second reactor and sent directly to a repository. The spherical particles of transmutation fuel are coated with an impervious, ceramic material which provides for long-term containment of the reacted transmutation fuel in the repository.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
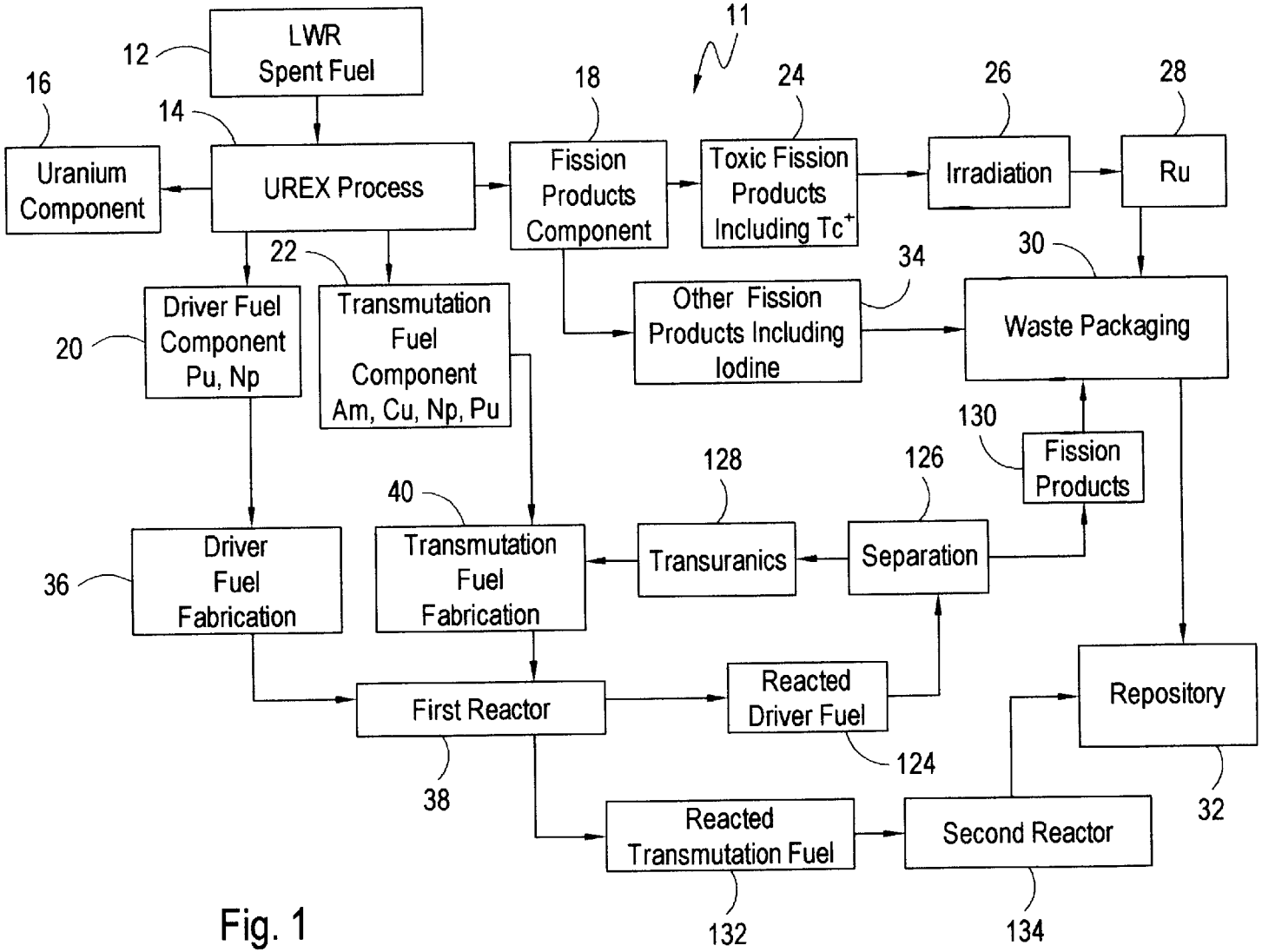
FIG. 1 is a functional block diagram of a method for treating spent fuel from a Light Water Reactor.

Referring initially to FIG. 1, a method 11 is shown for treating a spent fuel 12, such as the spent fuel assemblies from a Light Water Reactor (LWR), to achieve a high level of destruction of transuranic elements in the spent fuel 12 via transmutation with thermal neutrons. As shown, a conventional UREX process 14 can be used to separate the spent fuel 12 into components that include a Uranium component 16, a fission products component 18, a driver fuel component 20 and a transmutation fuel component 22. In greater detail, the Uranium component 16, which constitutes approximately 95% of the spent fuel 12, is relatively non-radioactive and can be disposed of without transmutation.

As further shown in FIG. 1, the fission products component 18, which constitutes approximately 4% of the spent fuel 12, includes toxic fission products 24, such as technicium$^{+}$ (constituting approximately 0.1% of the spent fuel 12) which can be irradiated (see box 26) to produce Ruthenium 28, which can then be packaged (box 30) and sent to a repository 32. If desired, the irradiation step (box 26) can be accomplished by using the technicium$^{+}$ as a burnable poison in a commercial reactor. As further shown, other fission products including Iodine 34 (which constitute approximately 3.9% of the spent fuel 12) can be packaged (box 30) and sent to repository 32.

Continuing with FIG. 1, it can be seen that after the UREX process 14, the driver fuel component 20, which constitutes approximately 0.9% of the spent fuel 12 and includes fissile isotopes, such as Plutonium$^{239}$ and Neptunium$^{237}$, is fabricated into coated driver particles (box 36) and then used to initiate a critical, self-sustaining, thermal-neutron fission reaction in the first reactor 38. Typically, the driver fuel component 20 is approximately 95% Plutonium and 5% Neptunium. Similarly, the transmutation fuel component, which constitutes approximately 0.1% of the spent fuel 12 and includes non-fissile materials, such as Americium, Curium and certain isotopes of Pu and Neptunium coming from the driver fuel, is fabricated into coated transmutation particles (box 40) and introduced into the first reactor 38 for transmutation with neutrons generated during fission of the driver fuel component 20. Typically, the transmutation fuel component 22 is approximately 42% Plutonium, 39% Americium, 16% Curium and 3% Neptunium. The transmutation fuel component 22 also provides stable reactivity feedback to control the nuclear reactor.

Figure 2:
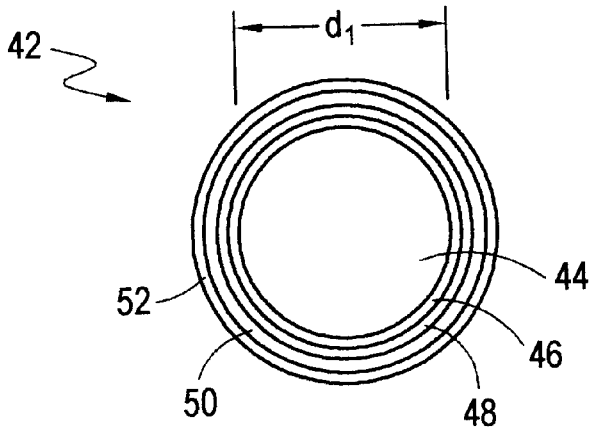
FIG. 2 is a sectional view through the center of a coated driver particle.

Referring now to FIG. 2, a coated driver particle is shown and generally designated 42. As shown, the coated driver particle 42 has a driver fuel kernel 44 having a kernel diameter $d_1$, that is fabricated from the driver fuel component 20. As further shown, the driver fuel kernel 44 is coated with a coating having a buffer layer 46, which can be a porous carbon layer. Functionally, the buffer layer 46 attenuates fission recoils and accommodates kernel swelling. Further, the pores provide a void volume for fission gases. The coating also includes an inner pyrocarbon layer 48, a silicon carbide (SiC) layer 50 and an outer pyrocarbon layer 52. The inner pyrocarbon layer 48 provides support for the silicon carbide layer 50 during irradiation, prevents the attachment of CI to driver fuel kernel 44 during manufacture, provides protection for SiC from fission products and CO, and retains gaseous fission products. The silicon carbide layer 50 constitutes the primary load bearing member and retains gas and metal fission products during long term storage. The outer pyrocarbon layer 52, provides structural support for the silicon carbide layer 50, provides a bonding surface for compacting, and provides a fission product barrier in particles having a defective silicon carbide layer 50.

Figure 3:
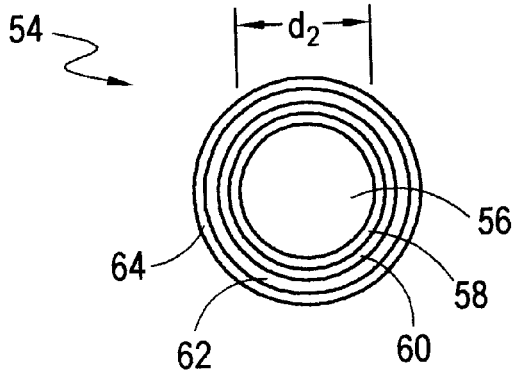
FIG. 3 is a sectional view through the center of a coated transmutation particle.

As shown in FIG. 3, a coated transmutation particle is shown and generally designated 54. As shown, the coated transmutation particle 54 has a transmutation fuel kernel 56 having a kernel diameter $d_2$, that is fabricated from the transmutation fuel component 22. As further shown, the transmutation fuel kernel 56 is coated with a coating having a buffer layer 58, inner pyrocarbon layer 60, a silicon carbide layer 62 and an outer pyrocarbon layer 64. These layers are similar to corresponding layers for the coated driver particle 42 described above (i.e. buffer layer 46, inner pyrocarbon layer 48, silicon carbide layer 50 and outer pyrocarbon layer 52) in composition and function.

Figure 4:
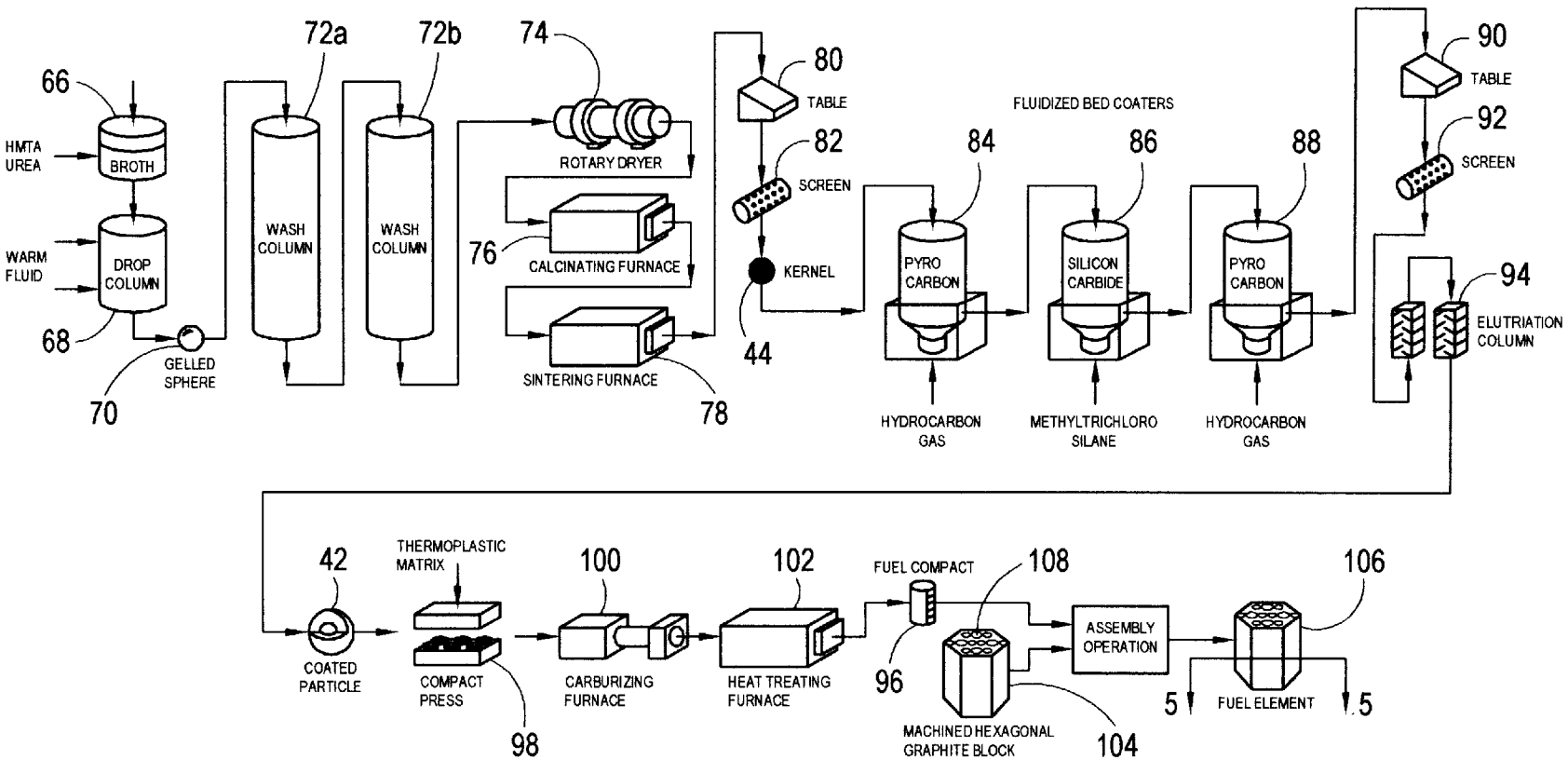
FIG. 4 is a process diagram for fabricating fuel elements.

FIG. 4 illustrates a manufacturing process for fabricating coated driver particles 42 and coated transmutation particles 54. In greater detail, for fabrication of coated driver particles 42, a concentrated Pu nitrate solution (e.g. 600–1100 g Pu/l) is first prepared as a broth by adding $H_2O$ and $NH_3$ to neutralize free nitric acid. Urea is added and the solution chilled to 10° C. at which point Hexamethylene-tetra-amine (HMTA) is added to form the broth 66 having a concentration of approximately 240–260 g Pu/l. Liquid droplets are generated by pulsing the broth 66 through needle orifices at drop column 68 and the droplets are gelled (creating gelled spheres 70) by heating the droplets in a bath at 80° C. to release $NH_3$ from the decomposition of HMTA and cause gelation.

Continuing with FIG. 4, after gelation, wash columns 72*a,b* are used to wash the gelled spheres 70 in dilute $NH_4OH$ to stabilize structure and remove residual reaction products and organics. From wash column 72*b*, rotary dryer 74 is used to dry the spheres in saturated air at 200° C. Next, the spheres are calcinated in a calcinating furnace 76 using dry air at 750° C. From the calcinating furnace 76, the spheres are sintered in pure $H_2$ at 1500–1600° C. in sintering furnace 78. A table 80 and screen 82 are used to discard unacceptable spheres. In one implementation, non-sphericity (i.e. the ratio of maximum to minimum diameter) is controlled to be less than 1.05. Acceptable spheres constitute the driver fuel kernels 44 which are then coated using fluidized bed coaters 84, 86, 88.

Cross-referencing FIGS. 2 and 4, it can be seen that fluidized bed coater 84 using hydrocarbon gas can be used to deposit the inner pyrocarbon layer 48. Similarly, fluidized bed coater 86 using methyltrichlorosilane can be used to deposit the silicon carbide layer 50, and fluidized bed coater 88 using hydrocarbon gas can be used to deposit the outer pyrocarbon layer 52. The coatings may also be applied in a continuous process using only one coater. Table 90, screen 92 and elutriation columns 94 are used to separate coated driver particles 42 of acceptable size, density and shape. Acceptable coated driver particles 42 are then used to prepare cylindrical driver fuel compacts 96. In greater detail, the coated driver particles 42 are placed in a compact press 98 with a thermoplastic or thermosetting matrix material wherein the combination is pressed into cylinders. The cylinders are then placed in a carburizing furnace 100, followed by a heat treatment furnace 102 to produce the driver fuel compacts 96. Compacts may also be treated with dry hydrochloric acid gas between carburizing furnace 100 and heat treatment furnace 102 to remove transuranics and other impurities from the compacts.

Figure 5:
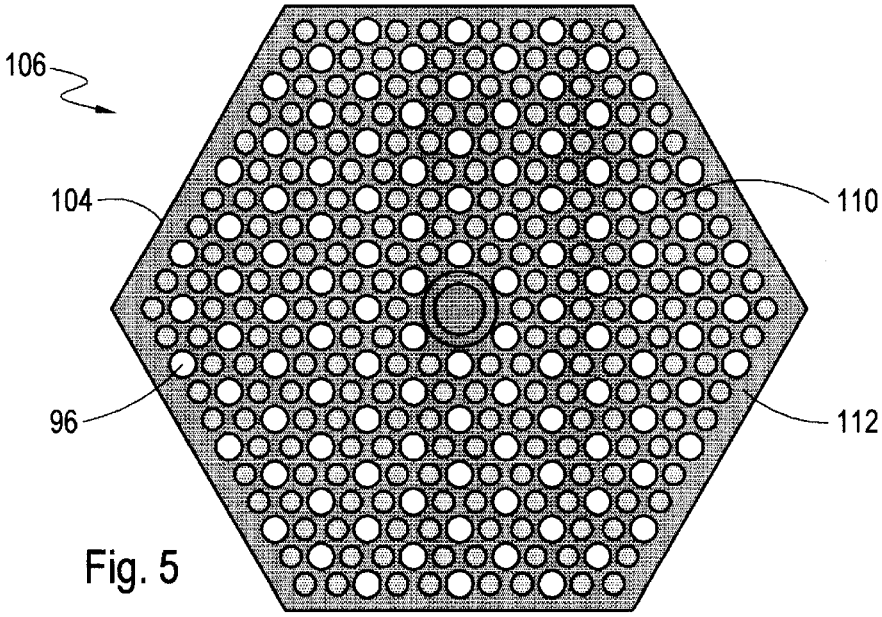
FIG. 5 is a sectional view of a fuel element as seen along line 5—5 in FIG. 4.

Continuing with FIG. 4, it can be seen that the driver fuel compacts 96 can then be placed in graphite blocks 104 to prepare fuel elements 106. With cross-reference to FIGS. 4 and 5, it can be seen that cylindrical holes 108 are machined in hexagonally shaped graphite blocks 104 to contain the cylindrical shaped fuel compacts 96. As best seen in FIG. 5, an exemplary fuel element 106 is shown having one-hundred-forty-four holes containing driver fuel compacts 96 that are uniformly distributed across the fuel element 106. Further, the exemplary fuel element 106 includes seventy-two holes for containing transmutation fuel compacts 110 uniformly distributed across the fuel element 106, and one-hundred-and-eight coolant channels 112 for passing a coolant such as Helium through the fuel element 106. It is to be appreciated that other similar hole configurations can be used in the fuel elements 106. It is to be appreciated by skilled artisans that the transmutation fuel compacts 110 can be prepared in a manner similar to the above described manufacturing process for preparing driver fuel compacts 96.

A plurality of fuel elements 106 containing driver fuel compacts 96 and transmutation fuel compacts 110 are then placed in first reactor 38 as shown in FIG. 1 for transmutation. As used herein, the term transmutation and derivatives thereof is herein intended to mean any process(es) which modify the nucleus of an atom such that the product nucleus has either a different mass number or a different atomic number than the reactant nucleus, and includes but is not limited to the fission, capture and decay processes. For example, non-fissile isotopes in the transmutation fuel component can generally be destroyed with thermal neutrons by first transmuting via one or more capture and/or decay processes to a fissile isotope, followed by fission.

Figure 6:
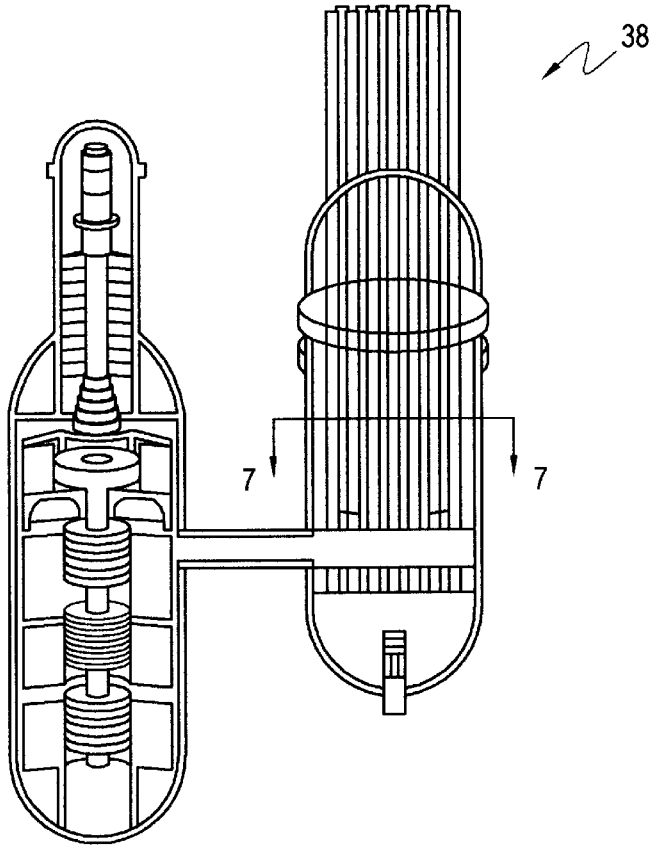
FIG. 6 is a Modular Helium Reactor (MHR) for hosting a critical, self-sustaining fission reaction.

Referring now to FIG. 6, an exemplary first reactor 38 is shown. For the method 11, a Modular Helium Reactor (MHR) can be used as the first reactor 38. In an MHR, Helium is circulated through the reactor vessel to regulate temperature and extract heat from the vessel. The extracted heat can then be used, for example, to produce electricity. The use of Helium as a coolant is advantageous because of Helium's transparency to neutrons. Additionally, Helium is chemically inert, and consequently, nuclear and chemical coolant-fuel interactions are minimized. Further, the Helium remains in the gaseous state providing reliable cooling that is easy to calculate and predict.

Figure 7:
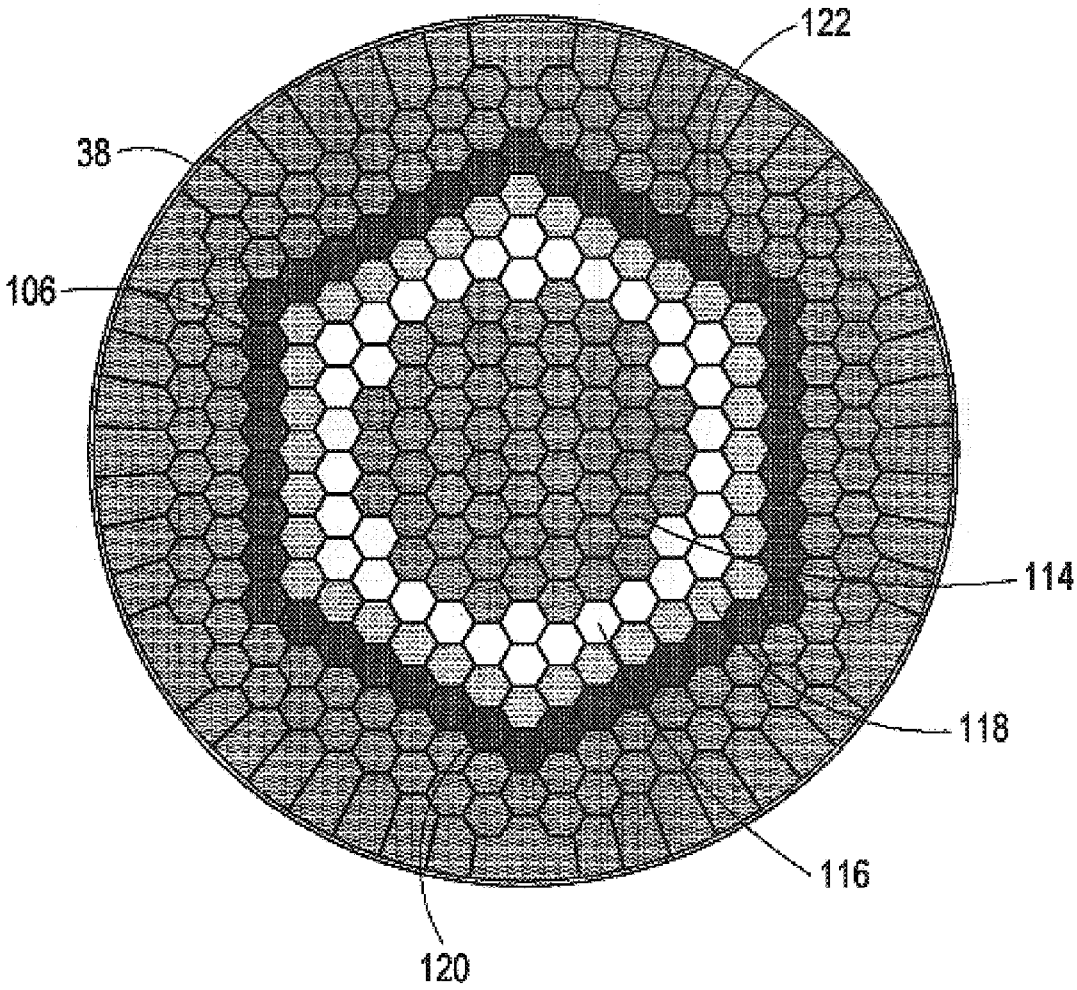
FIG. 7 is a sectional view as seen along line 7—7 in FIG. 6.

Referring now to FIG. 7, it can be seen that fuel elements 106 are arranged in the first reactor 38 in a substantially annular arrangement surrounding a central reflector 114. More specifically, as shown the fuel elements 106 are arranged in three substantially annular rings 116, 118, 120, with each ring 116, 118, 120 containing thirty-six columns of fuel elements 106 with each column having a stack of ten fuel elements 106.

Figure 8:
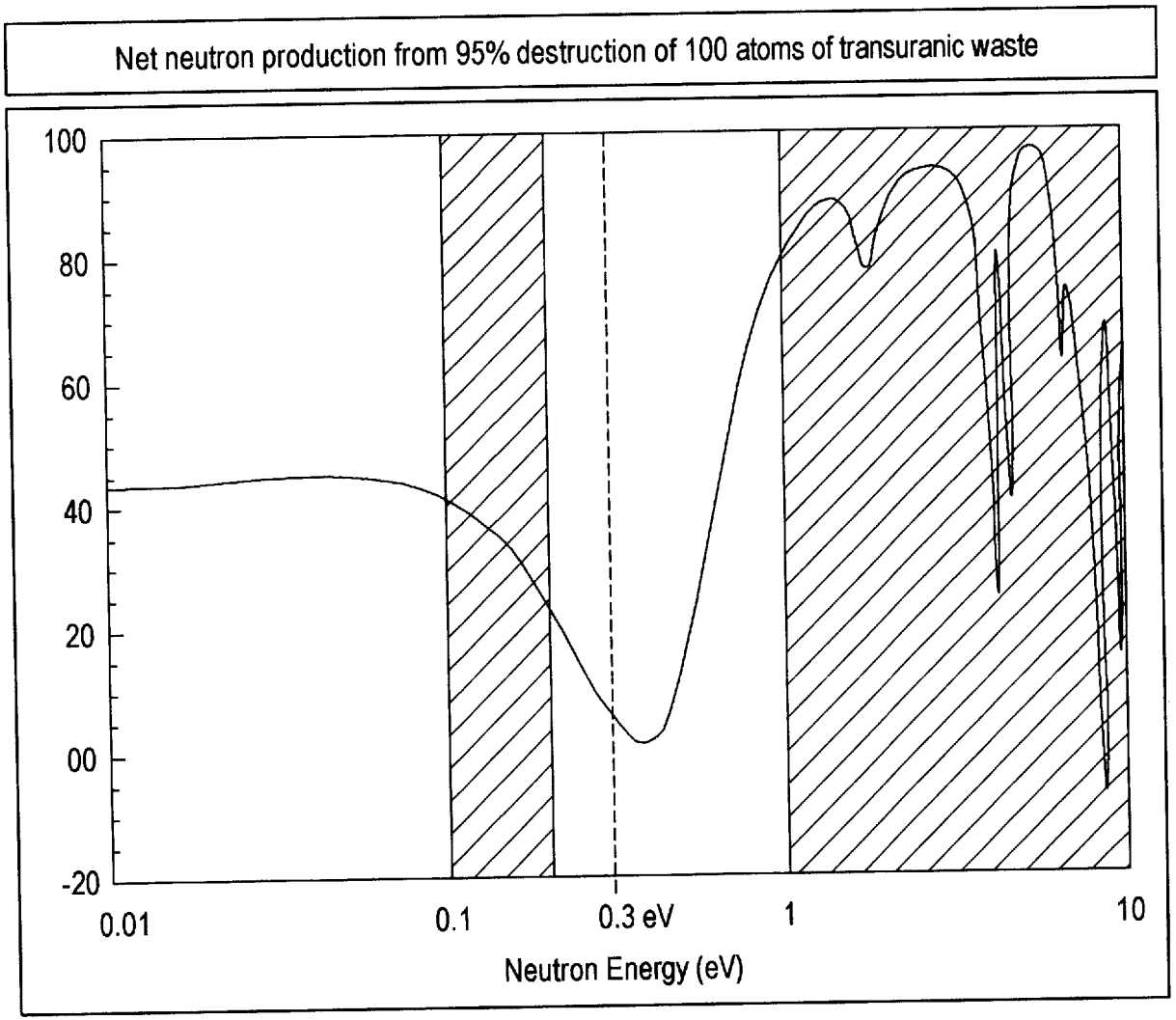
FIG. 8 is a graph showing the net neutron production from 95% destruction of 100 atoms of transuranic waste as a function of neutron energy.

A sufficient quantity of fissile material is included in the reactor 38 to initiate a self-sustaining critical, fission reaction. For the method 11, materials in the first reactor 38 are configured to promote fission of the driver fuel component 20 (See FIG. 1) and reduce neutron capture by the driver fuel component 20. More specifically, the first reactor 38 is configured to minimize any exposure of the driver fuel component 20 to thermal neutrons within an energy band wherein the $Pu^{239}$ in the driver fuel component 20 has a relatively high neutron capture cross-section and a relatively low fission cross-section. As best seen in FIG. 8, this energy band extends from approximately 0.2 eV to approximately 1.0 eV.

In one implementation of the method 11, materials in the reactor 38 are configured to maximize exposure of the driver fuel component 20 to thermal neutrons within an energy band extending from approximately 0.1 eV to approximately 0.2 eV. To achieve this, the driver fuel component 20 is formed into spherical particles having a relatively large driver fuel kernel diameter, $d_1$, (see FIG. 2) that is between approximately 270 $\mu$m and approximately 320 $\mu$m) to minimize neutron capture. Neutrons in the problematic energy band (i.e. neutrons between approximately 0.2 eV to approximately 1.0 eV) are limited to the surface of the relatively large driver fuel kernel 44, leaving the remainder of the relatively large driver fuel kernel 44 available for fission with neutrons having energies in the range of approximately 0.1 eV to approximately 0.2 eV.

Continuing with FIG. 7, it can be seen that the fuel elements 106 (which include graphite blocks 104 shown in FIG. 5) are placed in annular arrangement interposed between a central reflector 114 and an outer reflector 122. The graphite moderates fast neutrons from the fission reaction. Functionally, the graphite decreases fast neutron damage to fuel, reactor structures and equipment. A relatively high ratio (i.e. greater than 100:1) of graphite mass to fuel mass is used in the first reactor 38 to slow down neutrons within the problematic energy band (i.e. neutrons between approximately 0.2 eV to approximately 1.0 eV) before these neutrons reach the driver fuel component 20. Additionally, non-fissile transuranics, including but not limited to $Np^{237}$, $Am^{241}$ and $Pu^{240}$ in the driver fuel component 20 and transmutation fuel component 22 (see FIG. 1) can be used to assure negative reactivity feedbacks in the first reactor 38 and act as a burnable poison/fertile material to allow for extended burnups—replacing $Er^{167}$ or other similar parasitic poisons.

With cross reference now to FIGS. 1 and 7, the driver fuel component 20 and transmutation fuel component 22 remain in the first reactor 38 for approximately three years. Each year, 36 columns, 10 blocks high, of fresh (unreacted) fuel elements 106 are added to ring 118 and the partially reacted fuel elements 106 that have resided in ring 118 for one year are moved to ring 120. Also, partially reacted fuel elements 106 that have resided in ring 120 for one year are moved to ring 116 and reacted fuel elements 106 that have resided in ring 116 for one year are removed from the first reactor 38. During movement from ring 118 to ring 120 and movement from ring 120 to ring 116, the fuel elements are axially shuffled. More specifically, the fuel elements 106 in each column 0-1-2-3-4-5-6-7-8-9 are axially shuffled into the new column 4-3-2-1-0-9-8-7-6-5.

Continuing with cross-reference to FIGS. 1 and 7, it can be seen that reacted driver fuel 124 from the reacted fuel elements 106 that were removed from ring 116 of the first reactor 38 is then separated (box 126) into transuranics 128 and fission products 130 using a baking process to heat up and evaporate volatile elements. It is calculated that the reacted driver fuel 124 will generally consist of approximately one-third transuranics 128 and two-thirds fission products 130. As further shown, the fission products 130 can then be packaged (box 30) and sent to the repository 32. The transuranics 128 can be mixed with transmutation fuel component 22 (see box 40) to make coated transmutation particles 54 (see FIG. 3) that are then introduced into the first reactor 38 for a three year residence time.

Continuing with FIG. 1, reacted transmutation fuel 132 that has been removed from the first reactor 38 after a three year residence time is then introduced into a second reactor 134 for further transmutation. It is calculated that approximately ⅝ of the reacted transmutation fuel 132 will be transuranics with the remainder being fission products.

Figure 9:
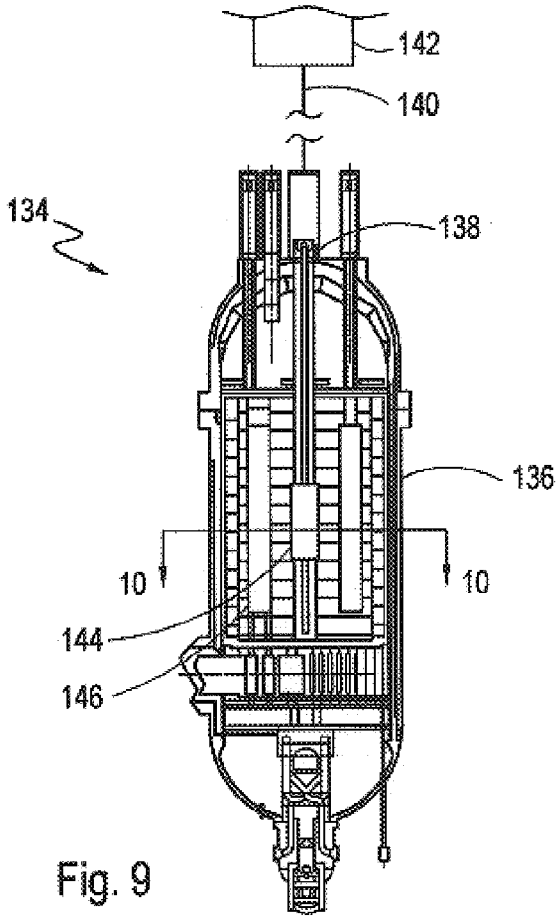
FIG. 9 is a Modular Helium Reactor (MHR) for hosting a subcritical, accelerator driven, transmutation reaction.

As shown in FIG. 9, the second reactor 134 includes a sealable, cylindrical housing 136 having a window 138 that allows a beam of protons 140 to pass through the window 138 and into the housing 136. In one implementation, the housing 136 is formed with a large length to diameter ratio to allow for adequate heat removal. A proton source 142, such as a particle accelerator, is provided to generate the beam of protons 140. A 10 MW proton source 142 capable of emitting a beam of protons 140 having energies of approximately 800 MeV and a current of approximately 10 mA can be used. A typical beam shape for the beam of protons 140 has a conical shape and a diameter of about 50 cm at the window 138 perpendicular to proton motion. The housing 136 is preferably sealable, air-tight and constructed primarily from high temperature steel alloys. A spallation target 144 is positioned inside the housing 136 for interaction with the beam of protons 140. The spallation target 144 can be made of any material known in the pertinent art, such as Tungsten, which will emit fast neutrons in response to collisions between the beam of protons 140 and the spallation target 144.

Like the first reactor 38 (see FIG. 6), the second reactor 134 (shown in FIG. 9) can be a Modular Helium Reactor (MHR) wherein Helium is circulated through the reactor vessel to regulate temperature and extract heat from the vessel. The extracted heat can then be used, for example, to produce electricity. In addition to the advantages cited above, Helium is particularly suitable for use in the second reactor 134 because protons at the expected energies can travel with essentially no energy loss through Helium gas for several kilometers.

Figure 10:
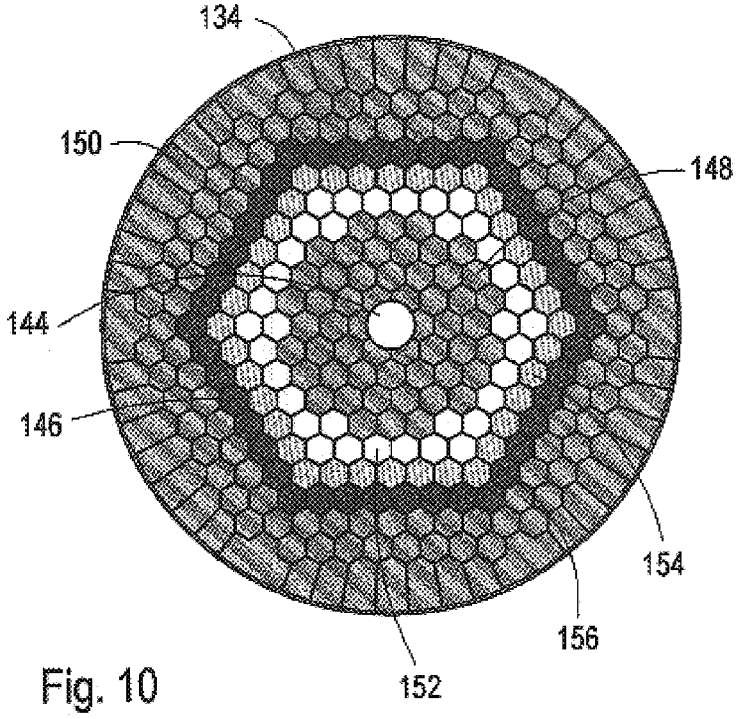
FIG. 10 is a sectional view as seen along line 10—10 in FIG. 9.

With cross reference now to FIGS. 9 and 10, it can be seen that hexagonally shaped fuel elements 146 containing reacted transmutation fuel 132 (see FIG. 1) are positioned in an annular arrangement surrounding the spallation target 144. The fuel elements 146 used in the second reactor 134 are similar to the fuel elements 106 described above for use in the first reactor 38. In greater detail, the fuel elements 146 consist of hexagonally shaped graphite blocks having machined holes for containing the reacted transmutation fuel 132 and channels to allow Helium coolant to be circulated through the blocks.

Referring now to FIG. 10, it can be seen that fuel elements 146 are arranged in the second reactor 134 in a substantially annular arrangement surrounding the spallation target 144. A central reflector 148 is interposed between the spallation target 144 and the fuel elements 146 and a outer reflector 150 surrounds the fuel elements 146. As further shown, the fuel elements 146 are arranged in three annular rings 152, 154, 156, with each ring 152, 154, 156 containing thirty-six columns of fuel elements 146 with each column having a stack of ten fuel elements 146.

The presence of fissile materials in the second reactor 134 are limited to ensure that the reaction remains subcritical. For the method 11, materials in the second reactor 134 are configured to promote transmutation of the transmutation fuel component 22 (See FIG. 1) with neutrons within an energy band extending from approximately 1.0 eV to approximately 10.0 eV (see FIG. 8). Thermal neutrons within this energy band (i.e. approximately 1.0 eV to approximately 10.0 eV) are referred to as epithermal neutrons herein.

To achieve this, the transmutation fuel component 22 is formed into substantially spherical particles having a relatively small transmutation fuel kernel diameter, $d_2$, (see FIG. 2) that is between approximately 130 $\mu$m and approximately 170 μm, to maximize the surface area of the transmutation fuel component 22 and thereby increase transmutation using epithermal neutrons. Alternatively, diluted 250 μm transmutation fuel kernels 56 (having the same amount of transmutation fuel component 22 per kernel as the undiluted 150 μm kernels) can be used to achieve the same effect as 150 μm kernels while facilitating the manufacturability of the particles. The same coated transmutation particles 54 (see FIG. 3) are used in both the first reactor 38 and second reactor 134.

Continuing with FIG. 10, it can be seen that the fuel elements 146 (which include graphite blocks) are placed in a substantially annular arrangement interposed between a central reflector 148 and an outer reflector 150. The graphite in the second reactor 134 moderates fast neutrons from the spallation target 144. One collateral benefit of the graphite is that it prevents fast neutron damage to reactor structures and equipment. A relatively low ratio (i.e. less than 10:1) of graphite mass to fuel mass can be used in the second reactor 134 to increase transmutation of the transmutation fuel component 22 with epithermal neutrons.

Continuing with FIG. 10, the reacted transmutation fuel 132 from the first reactor 38 remains in the second reactor 134 for approximately four years. Every one and one third years, thirty-six columns of fuel elements 146 with each column having a stack of ten fuel elements 146 containing reacted transmutation fuel 132 from one or more first reactors 38 are added to the second reactor 134. In one implementation of the method 11, the second reactor 134 is sized to receive reacted transmutation fuel 132 from four first reactors 38, which in turn are sized to receive all the spent fuel from five large Light Water Reactors (i.e. each first reactor 38 is sized to receive approximately all the spent fuel from 1.25 large LWR's). The three hundred and sixty fuel elements 146 are initially introduced into ring 156 of the second reactor 134. Fuel elements 146 that have resided in ring 156 for approximately one and one third years are moved to ring 154 with axial reshuffling as described above. Fuel elements 146 that have resided in ring 154 for approximately one and one third years are moved to ring 152 with axial reshuffling, and fuel elements 146 that have resided in ring 152 for approximately one and one third years are removed from the second reactor 134. It is calculated that the fuel elements 146 removed from the second reactor 134 will contain approximately ⅛ transuranics and ⅞ fission products. This material is then sent directly to repository 32. The spherical particles of transmutation fuel are coated with an impervious, ceramic material which provides for containment of the treated transmutation fuel in the repository 32. Calculations indicate that the method 11 as described above can destroy all of the fissile transuranics, such as $Pu^{239}$, and 95% or more of the remaining transuranics present in the LWR spent fuel.

While the particular system and method for destroying radioactive waste as herein shown and disclosed in detail are fully capable of obtaining the objects and providing the advantages herein before stated, it is to be understood that they are merely illustrative of the presently preferred embodiments of the invention and that no limitations are intended to the details of construction or design herein shown other than as described in the appended claims.

What is claimed is:

1. A method for transmuting spent fuel from a nuclear reactor, said method comprising the steps of:

separating the spent fuel into components including a first component comprising at least one fissile isotope and a second component comprising at least one nonfissile, transuranic isotope;

disposing said separated first and second components in a reactor;

initiating a critical, self-sustaining fission reaction in said reactor to transmute at least a portion of said first component and produce a reacted first component and a reacted second component;

separating said reacted first component into fractions including a transuranic fraction comprising at least one nonfissile, transuranic isotope;

reintroducing said transuranic fraction into said reactor for further transmutation;

positioning said reacted second component at a distance from a spallation target; and transmuting said reacted second component with neutrons from said spallation target.

2. A method as recited in claim 1 wherein said first component comprises Plutonium239.

3. A method as recited in claim 2 further comprising the step of forming said first component in substantially spherical kernels having a diameter between approximately 270 μm and 330 μm to minimize neutron capture by said Plutonium239 in the energy region between approximately 0.2 eV and approximately 1 eV.

4. A method as recited in claim 3 further comprising the step of coating said kernels with a ceramic coating.

5. A method as recited in claim 4 further comprising the steps of:

providing a graphite block formed with at least one hole;

disposing said coated kernels in said hole; and disposing said block and said coated kernels in said reactor.

6. A method as recited in claim 4 further comprising the steps of:

disposing a graphite central reflector in said reactor;

providing a plurality of graphite blocks with each block formed with at least one hole;

disposing said coated kernels in at least one said hole of each said block; and positioning said blocks in said reactor in a substantially annular arrangement to surround said graphite central reflector.

7. A method as recited in claim 1 wherein said second component comprises a non-fissile isotope of a transuranic element to provide a stable, negative temperature coefficient of reactivity for safe control of the nuclear reaction, said element selected from the group consisting of Plutonium, Americium, Curium and Neptunium.

8. A method as recited in claim 2 further comprising the steps of:

providing an amount of said second component suitable to prepare an undiluted kernel of said second component having a diameter of approximately 1.50 μm; and diluting said amount of said second component to prepare a substantially spherical kernel having a diameter between approximately 220 μm and 350 μm.

9. A method as recited in claim 2 further comprising the step of circulating Helium through said reactor to regulate the temperature inside said reactor.

10. A method as recited in claim 1 wherein said step of transmuting said reacted second component with neutrons from said spallation target comprises the steps of:

using a particle accelerator to generate a beam of protons; and directing said beam of protons to strike said spallation target with said protons and generate fast neutrons.

* * * * *